US010163555B2

(12) United States Patent
Yuasa et al.

(10) Patent No.: US 10,163,555 B2
(45) Date of Patent: Dec. 25, 2018

(54) COIL UNIT

(71) Applicant: TOYOTA JIDOSHA KABUSHIKI KAISHA, Toyota-shi, Aichi-ken (JP)

(72) Inventors: Hiroaki Yuasa, Miyoshi (JP); Shuhei Ejima, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 374 days.

(21) Appl. No.: 15/198,979

(22) Filed: Jun. 30, 2016

(65) Prior Publication Data

US 2017/0040098 A1 Feb. 9, 2017

(30) Foreign Application Priority Data

Aug. 7, 2015 (JP) ..... 2015-157197

(51) Int. Cl.

| | |
|---|---|
| ***H01F 27/24*** | (2006.01) |
| ***H01F 3/10*** | (2006.01) |
| ***H01F 3/12*** | (2006.01) |
| ***H01F 38/14*** | (2006.01) |

(52) U.S. Cl.

CPC ..... *H01F 27/24* (2013.01); *H01F 3/10* (2013.01); *H01F 3/12* (2013.01); *H01F 38/14* (2013.01)

(58) Field of Classification Search

CPC ..... H01F 27/24; H01F 38/14

See application file for complete search history.

(56) References Cited

U.S. PATENT DOCUMENTS

| | | | | |
|---|---|---|---|---|
| 7,741,734 | B2 | 6/2010 | Joannopoulos et al. | |
| 2004/0085173 | A1* | 5/2004 | Decristofaro | H01F 27/245 336/178 |
| 2007/0222542 | A1 | 9/2007 | Joannopoulos et al. | |
| 2008/0116847 | A1* | 5/2008 | Loke | H02J 5/005 320/108 |
| 2008/0129246 | A1* | 6/2008 | Morita | B60L 5/005 320/108 |
| 2008/0278264 | A1 | 11/2008 | Karalis et al. | |
| 2009/0195332 | A1 | 8/2009 | Joannopoulos et al. | |
| 2009/0195333 | A1 | 8/2009 | Joannopoulos et al. | |
| 2009/0224856 | A1 | 9/2009 | Karalis et al. | |
| 2009/0267709 | A1 | 10/2009 | Joannopoulos et al. | |
| 2009/0267710 | A1 | 10/2009 | Joannopoulos et al. | |
| 2010/0007215 | A1* | 1/2010 | Sakuma | H01F 38/14 307/104 |
| 2010/0059258 | A1* | 3/2010 | Yang | B32B 7/12 174/257 |
| 2010/0096934 | A1 | 4/2010 | Joannopoulos et al. | |
| 2010/0102639 | A1 | 4/2010 | Joannopoulos et al. | |

(Continued)

FOREIGN PATENT DOCUMENTS

| | | | |
|---|---|---|---|
| AU | 2006269374 | B2 | 1/2007 |
| AU | 2007349874 | A2 | 10/2008 |

(Continued)

*Primary Examiner* — Elvin G Enad
*Assistant Examiner* — Malcolm Barnes
(74) *Attorney, Agent, or Firm* — Oliff PLC

(57) ABSTRACT

A coil unit includes a ferrite including a coil base in a form of a frame, on which a coil is arranged, and formed from a plurality of divided ferrites. The plurality of divided ferrites include a first divided ferrite and a second divided ferrite which form a corner piece and a third divided ferrite and a fourth divided ferrite which form a side piece.

2 Claims, 10 Drawing Sheets

(56) References Cited

U.S. PATENT DOCUMENTS

| | | | | |
|---|---|---|---|---|
| 2010/0102640 | A1 | 4/2010 | Joannopoulos et al. | |
| 2010/0102641 | A1 | 4/2010 | Joannopoulos et al. | |
| 2010/0117455 | A1 | 5/2010 | Joannopoulos et al. | |
| 2010/0117456 | A1 | 5/2010 | Karalis et al. | |
| 2010/0123353 | A1 | 5/2010 | Joannopoulos et al. | |
| 2010/0123354 | A1 | 5/2010 | Joannopoulos et al. | |
| 2010/0123355 | A1 | 5/2010 | Joannopoulos et al. | |
| 2010/0127573 | A1 | 5/2010 | Joannopoulos et al. | |
| 2010/0127574 | A1 | 5/2010 | Joannopoulos et al. | |
| 2010/0127575 | A1 | 5/2010 | Joannopoulos et al. | |
| 2010/0133918 | A1 | 6/2010 | Joannopoulos et al. | |
| 2010/0133919 | A1 | 6/2010 | Joannopoulos et al. | |
| 2010/0133920 | A1 | 6/2010 | Joannopoulos et al. | |
| 2010/0171370 | A1 | 7/2010 | Karalis et al. | |
| 2010/0181844 | A1 | 7/2010 | Karalis et al. | |
| 2010/0187911 | A1 | 7/2010 | Joannopoulos et al. | |
| 2010/0201205 | A1 | 8/2010 | Karalis et al. | |
| 2010/0207458 | A1 | 8/2010 | Joannopoulos et al. | |
| 2010/0225175 | A1 | 9/2010 | Karalis et al. | |
| 2010/0231053 | A1 | 9/2010 | Karalis et al. | |
| 2010/0237706 | A1 | 9/2010 | Karalis et al. | |
| 2010/0237707 | A1 | 9/2010 | Karalis et al. | |
| 2010/0237708 | A1 | 9/2010 | Karalis et al. | |
| 2010/0253152 | A1 | 10/2010 | Karalis et al. | |
| 2010/0264745 | A1 | 10/2010 | Karalis et al. | |
| 2013/0127409 | A1 | 5/2013 | Ichikawa | |
| 2013/0193749 | A1 | 8/2013 | Nakamura et al. | |
| 2014/0049212 | A1* | 2/2014 | Sawa | H01F 38/14 320/108 |
| 2014/0327394 | A1* | 11/2014 | Asselin | H01F 3/10 320/108 |
| 2015/0008877 | A1 | 1/2015 | Ichikawa et al. | |
| 2015/0077053 | A1* | 3/2015 | Stamenic | H02J 7/0042 320/109 |
| 2015/0170814 | A1* | 6/2015 | Blum | B60L 11/182 307/9.1 |
| 2016/0314884 | A1* | 10/2016 | Lee | H01F 27/245 |

FOREIGN PATENT DOCUMENTS

| | | | | |
|---|---|---|---|---|
| AU | 2010200044 | A1 | 1/2010 | |
| AU | 2006269374 | C1 | 3/2010 | |
| CA | 2 615 123 | A1 | 1/2007 | |
| CA | 2 682 284 | A1 | 10/2008 | |
| CN | 1735948 | A | 2/2006 | |
| CN | 101258658 | A | 9/2008 | |
| CN | 101425743 | A | 5/2009 | |
| CN | 101682216 | A | 3/2010 | |
| CN | 101860089 | A | 10/2010 | |
| CN | 102568769 | A | 7/2012 | |
| DE | 102006025458 | A1 * | 12/2007 | H02J 17/00 |
| EP | 1004888 | A1 * | 5/2000 | G01R 33/383 |
| EP | 1 902 505 | A2 | 3/2008 | |
| EP | 2 130 287 | A1 | 12/2009 | |
| IN | 735/DELNP/2008 | | 5/2008 | |
| IN | 6195/DELNP/2008 | | 7/2010 | |
| JP | 2008-120239 | A | 5/2008 | |
| JP | 2009-501510 | A | 1/2009 | |
| JP | 2013-110822 | A | 6/2013 | |
| JP | 2013-126327 | A | 6/2013 | |
| JP | 2013-146148 | A | 7/2013 | |
| JP | 2013-146154 | A | 7/2013 | |
| JP | 2013-154815 | A | 8/2013 | |
| KR | 2008-0031398 | A | 4/2008 | |
| KR | 2010-0015954 | A | 2/2010 | |
| TW | 200832860 | A | 8/2008 | |
| WO | 2007/008646 | A2 | 1/2007 | |
| WO | 2008/118178 | A1 | 10/2008 | |

* cited by examiner

COIL UNIT

This nonprovisional application is based on Japanese Patent Application No. 2015-157197 filed with the Japan Patent Office on Aug. 7, 2015, the entire contents of which are hereby incorporated by reference.

BACKGROUND OF THE INVENTION

Field of the Invention

The present invention relates to a coil unit including a coil and a ferrite having the coil arranged.

Description of the Background Art

Various contactless charging systems for transmitting electric power from an electric power transmission apparatus to an electric power reception apparatus in a contactless manner have conventionally been proposed (Japanese Patent Laying-Open No. 2013-154815, Japanese Patent Laying-Open No. 2013-146154, Japanese Patent Laying-Open No. 2013-146148, Japanese Patent Laying-Open No. 2013-110822, and Japanese Patent Laying-Open No. 2013-126327).

Japanese Patent Laying-Open No. 2008-120239 describes a coil unit including a coil and an E-shaped core. The E-shaped core is formed in a rectangular shape when viewed from above and includes projecting portions formed in two respective side portions and a central projecting portion formed in a central portion.

This E-shaped core is formed by stacking a plurality of block cores, and the block cores are arranged to be in contact with each other. The coil is attached to the central projecting portion of the E-shaped core.

In the coil unit described in Japanese Patent Laying-Open No. 2008-120239, however, the block cores are arranged without leaving any space therebetween. Therefore, a necessary amount of ferrite is large and manufacturing cost is high.

The inventors of the present application have studied about reduction in necessary amount of ferrite by forming a ferrite from a plurality of divided ferrites and arranging ferrites at a distance from each other.

A specifically studied ferrite includes a coil base in a form of a frame on which a coil is arranged and a central ferrite arranged to be in contact with an inner peripheral portion of the coil base and surrounded by the coil.

The inventors have formed the coil base by arranging divided ferrites in a square shape at a distance from each other in a form of a frame, and formed the central ferrite by arranging divided ferrites in a square shape at a distance from each other.

A divided ferrite located at a corner portion of the central ferrite and a divided ferrite located at a corner portion of the coil base are in point contact with each other, and an area of contact is small. Therefore, it has been found that magnetic saturation may occur in a portion of contact between the divided ferrites when a current flows through the coil or when an external magnetic flux intersects with the coil.

Then, the inventors have formed a coil base by radially dividing the coil base from the center of the coil base and arranging in a form of a frame, eight divided ferrites in a shape of a right-angled trapezoid. Specifically, the divided ferrites have been arranged such that a short side portion of each divided ferrite is disposed around an inner periphery of the coil base and an outer periphery of each divided ferrite is disposed around an outer periphery of the coil base. Thus, when a central ferrite is arranged on the coil base, each divided ferrite is in contact with the central ferrite at the short side portion of the right-angled trapezoid, and an area of contact between each divided ferrite and the central ferrite can be secured.

In application to a coil unit without a central ferrite as well, divided ferrites forming a coil base can be identical in shape.

The coil base above, however, suffers from a disadvantage that a large-sized coil base cannot be formed.

In general, a divided ferrite is formed by molding a powdery raw material for forming a ferrite in a mold die and firing a molded product. In manufacturing a large divided ferrite, a large molded product should be fired in firing. In firing, a temperature distribution tends to be uneven and a fracture or a crack tends to be produced. Therefore, it is currently difficult to manufacture a large divided ferrite.

Therefore, it has been found that the coil base studied by the inventors suffers from such a problem that only a small-sized coil base can be formed.

The present invention was made in view of the problems above, and an object of the present invention is to provide a coil unit including a coil base which can be applied also to a large-sized coil base and can ensure an area of contact with a central ferrite even when the central ferrite is arranged on an upper surface of the coil base.

SUMMARY OF THE INVENTION

In one aspect, a coil unit includes a coil and a ferrite including a coil base in a form of a frame, on which the coil is arranged, and formed from a plurality of divided ferrites. The coil base includes a plurality of corner portions. The coil base includes a plurality of corner pieces which form the corner portion and are provided at a distance from each other and side pieces provided between the corner pieces. The divided ferrite includes a short side portion, a long side portion provided at a distance from the short side portion and being longer than the short side portion, a first side portion connecting one end of the short side portion and one end of the long side portion to each other, and a second side portion connecting the other end of the short side portion and the other end of the long side portion to each other and being longer than the first side portion. The plurality of divided ferrites include a first divided ferrite and a second divided ferrite which form the corner piece and a third divided ferrite and a fourth divided ferrite which form the side piece. The first divided ferrite and the second divided ferrite are arranged such that the second side portions are opposed to each other, an inner peripheral side of the corner piece is formed from a short side portion of the first divided ferrite and a short side portion of the second divided ferrite, and an outer peripheral side of the corner piece is formed from a long side portion of the first divided ferrite and a long side portion of the second divided ferrite. The third divided ferrite and the fourth divided ferrite are arranged such that the second side portions are opposed to each other. An inner peripheral side of the side piece is formed from a short side portion of the third divided ferrite and a long side portion of the fourth divided ferrite, and an outer peripheral side of the side piece is formed from a long side portion of the third divided ferrite and a short side portion of the fourth divided ferrite.

The coil unit can achieve reduction in manufacturing cost because the coil base can be formed from identical divided ferrites.

The corner piece and the side piece of the coil base are formed by combining divided ferrites and a size of each divided ferrite can be suppressed.

The short side portion or the long side portion of each divided ferrite is located in an inner peripheral portion of the coil base. Therefore, even when the central ferrite is arranged to be in contact with the inner peripheral portion of the coil base, the short side portion or the long side portion of each divided ferrite is in contact with the central ferrite and an area of contact between each divided ferrite and the central ferrite can be ensured. Thus, occurrence of magnetic saturation can be suppressed.

The ferrite includes a central ferrite arranged to be in contact with an inner peripheral portion of the coil base and surrounded by the coil. The central ferrite includes a plurality of corner portions. The central ferrite includes a plurality of central corner pieces which form the corner portion of the central ferrite and are arranged in a form of a frame. The plurality of divided ferrites include a fifth divided ferrite and a sixth divided ferrite which form the central corner piece. The fifth divided ferrite and the sixth divided ferrite are arranged such that the second side portions are opposed to each other. An inner peripheral side of the central corner piece is formed from a short side portion of the fifth divided ferrite and a short side portion of the sixth divided ferrite. An outer peripheral side of the central corner piece is formed from a long side portion of the fifth divided ferrite and a long side portion of the sixth divided ferrite.

According to the coil unit, the central ferrite can also be formed from a divided ferrite identical in shape to the divided ferrite forming the coil base.

The foregoing and other objects, features, aspects and advantages of the present invention will become apparent from the following detailed description of the present invention when taken in conjunction with the accompanying drawings.

DESCRIPTION OF THE PREFERRED EMBODIMENTS

Figure 1:
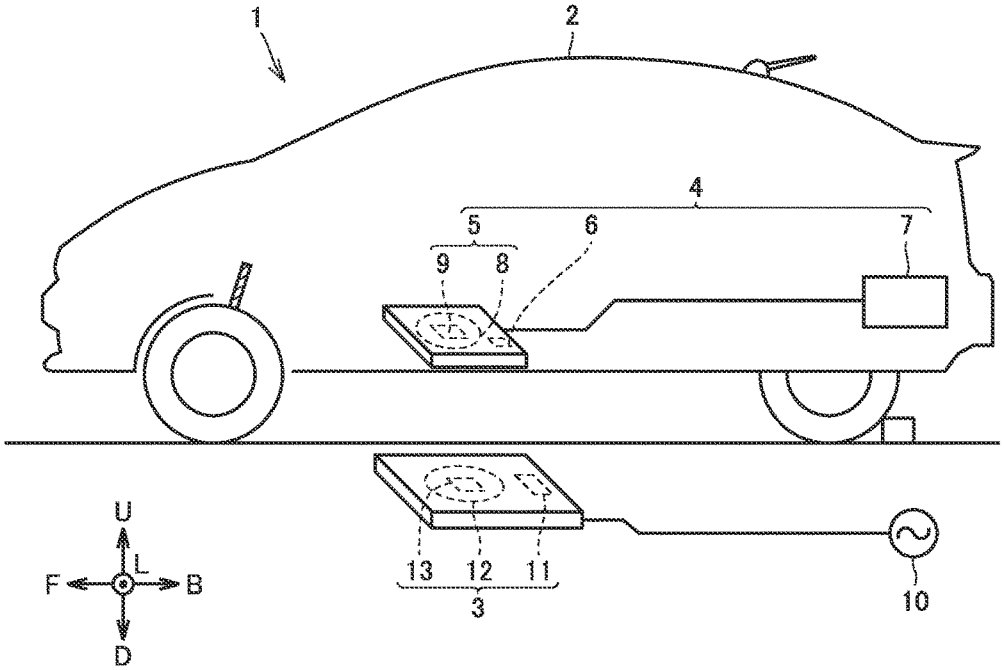
FIG. 1 is a diagram schematically showing a contactless charging system 1.
Figure 2:
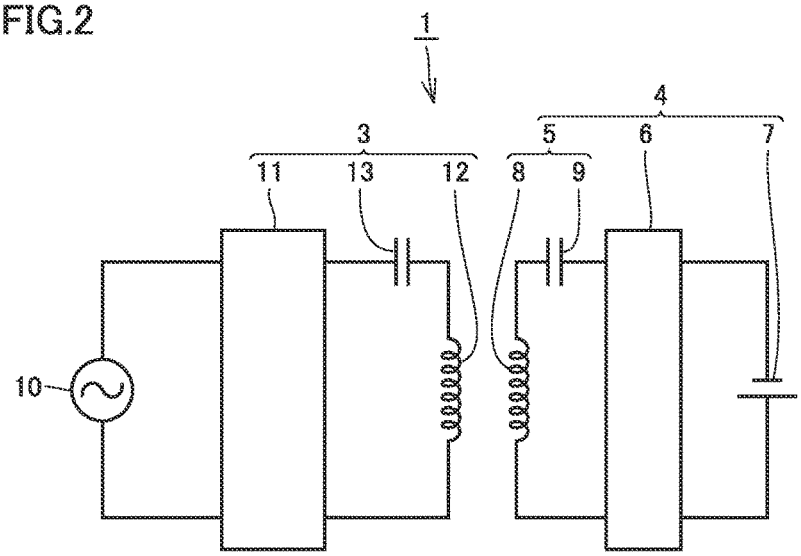
FIG. 2 is a circuit diagram schematically showing contactless charging system 1.

FIG. 1 is a diagram schematically showing a contactless charging system 1 and FIG. 2 is a circuit diagram schematically showing contactless charging system 1. As shown in FIGS. 1 and 2, contactless charging system 1 includes an electric power reception unit 4 mounted on a vehicle 2 and an electric power transmission apparatus 3 transmitting electric power to electric power reception unit 4 in a contactless manner.

Electric power reception unit 4 includes an electric power reception apparatus 5 which receives electric power transmitted from electric power transmission apparatus 3, a rectifier 6 which converts AC power received by electric power reception apparatus 5 into DC power and regulates a voltage, and a battery 7 which stores DC power supplied from rectifier 6.

Electric power stored in battery 7 is supplied to a not-shown drive motor which drives wheels.

Electric power reception apparatus 5 includes an electric power reception coil 8 and a capacitor 9 connected to rectifier 6, which form a serial LC resonant circuit.

Electric power transmission apparatus 3 includes a frequency converter 11 connected to a power supply 10 and an electric power transmission coil 12 and a capacitor 13 connected to frequency converter 11.

Frequency converter 11 adjusts a frequency of AC power supplied from power supply 10 for supply to electric power transmission coil 12 and capacitor 13 and regulates a voltage to be supplied to electric power transmission coil 12 and capacitor 13. Electric power transmission coil 12 and capacitor 13 form a serial LC resonant circuit.

A resonant frequency of the resonant circuit formed by electric power transmission coil 12 and capacitor 13 and a resonant frequency of the resonant circuit formed by electric power reception coil 8 and capacitor 9 are configured to match or substantially match with each other.

The resonant circuit formed by electric power transmission coil 12 and capacitor 13 and the resonant circuit formed by electric power reception coil 8 and capacitor 9 each have a Q value not smaller than 100.

Figure 3:
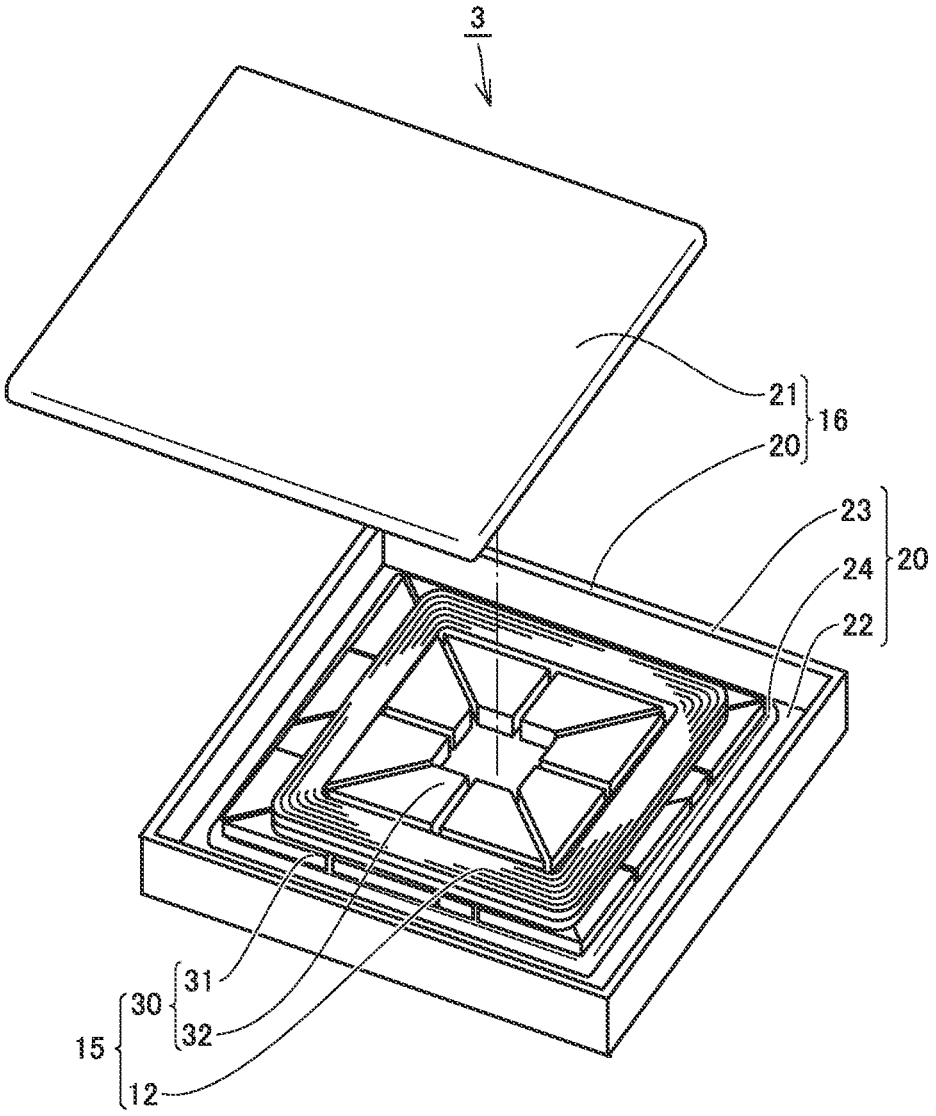
FIG. 3 is an exploded perspective view showing an electric power transmission apparatus 3.

FIG. 3 is an exploded perspective view showing electric power transmission apparatus 3. As shown in FIG. 3, electric power transmission apparatus 3 includes a coil unit 15 and a housing 16 which accommodates coil unit 15.

Housing 16 includes a case main body 20 provided with an opening which opens upward and a resin lid 21 arranged to close the opening of case main body 20.

Case main body 20 includes a base plate 22, a peripheral wall portion 23 provided around an outer peripheral portion of base plate 22, and an accommodation portion 24 provided in a central portion of base plate 22 and accommodating frequency converter 11 and capacitor 13. Coil unit 15 includes a ferrite 30 and electric power transmission coil 12.

Figure 4:
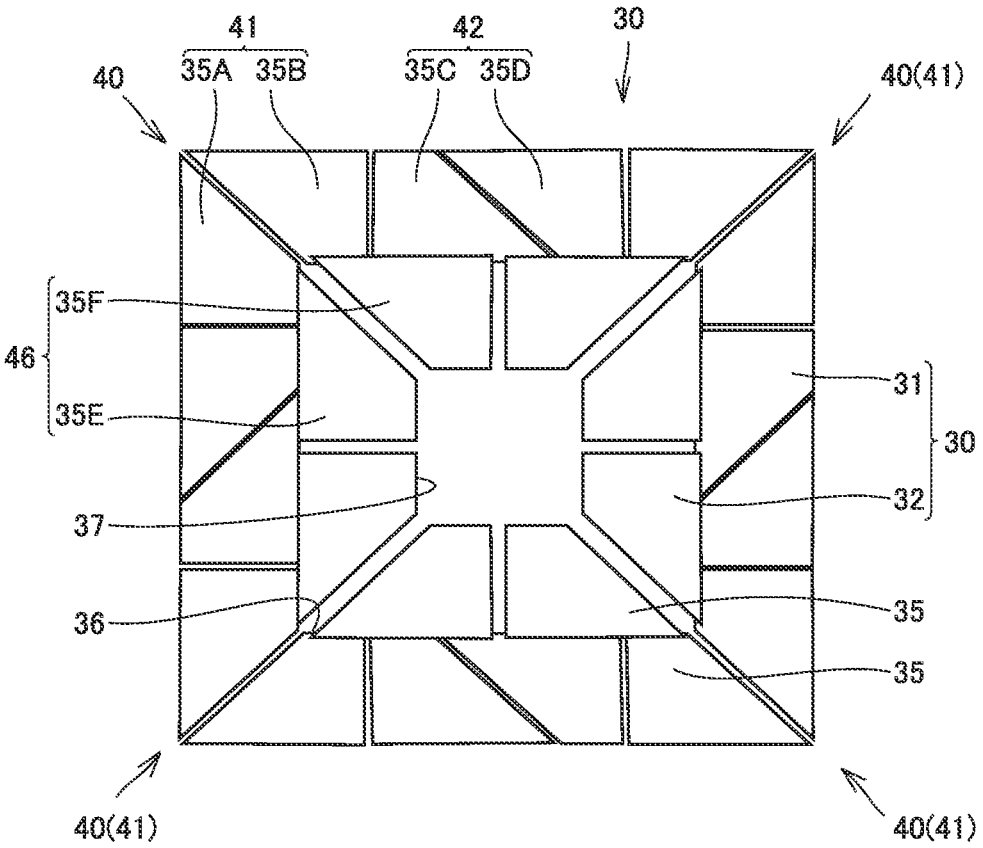
FIG. 4 is a plan view showing a ferrite 30.

FIG. 4 is a plan view showing ferrite 30. As shown in FIG. 4, ferrite 30 includes a coil base 31 in a form of a frame which includes electric power transmission coil 12 arranged on an upper surface and a central ferrite 32 arranged on the upper surface of coil base 31, and ferrite 30 is formed from a plurality of divided ferrites 35.

Coil base 31 is formed in a form of a frame, and an opening 36 is provided in a central portion of coil base 31. Central ferrite 32 is arranged on the upper surface of coil base 31 so as to be in contact with an inner peripheral portion of coil base 31. As shown in FIG. 3, electric power transmission coil 12 is arranged on the upper surface of coil base 31, and central ferrite 32 is surrounded by electric power transmission coil 12.

Figure 5:
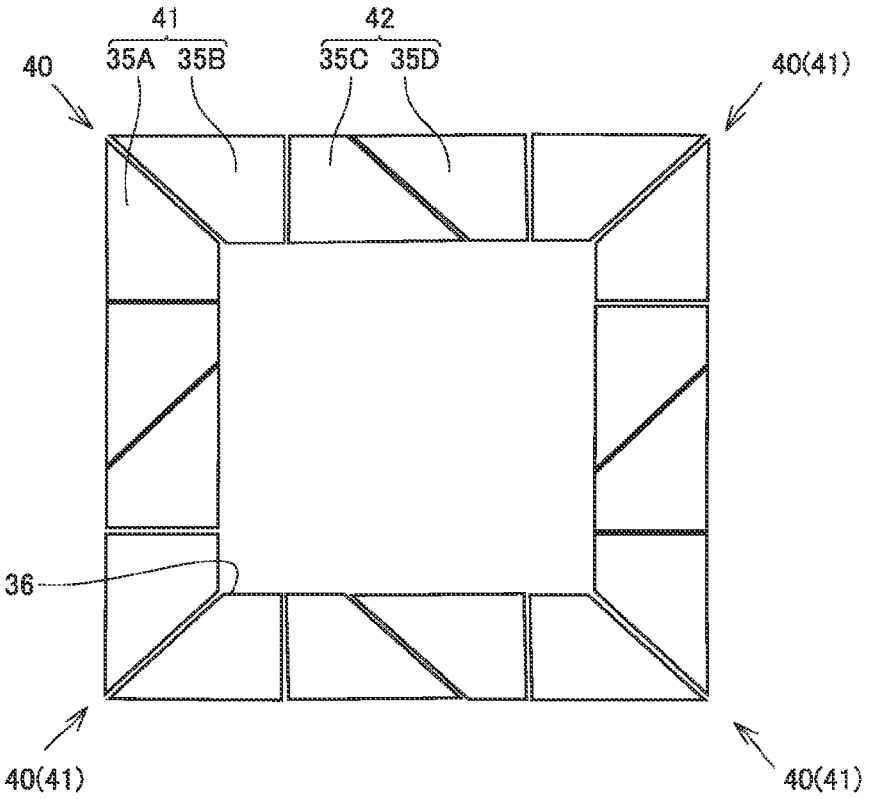
FIG. 5 is a plan view showing a coil base 31.

FIG. 5 is a plan view showing coil base 31. Coil base 31 includes a plurality of corner portions 40 and is formed in a polygonal shape.

Coil base 31 includes a plurality of corner pieces 41 which form corner portion 40 and a plurality of side pieces 42 arranged between corner pieces 41. Corner piece 41 and side piece 42 are formed by combining divided ferrites 35.

Figure 6:
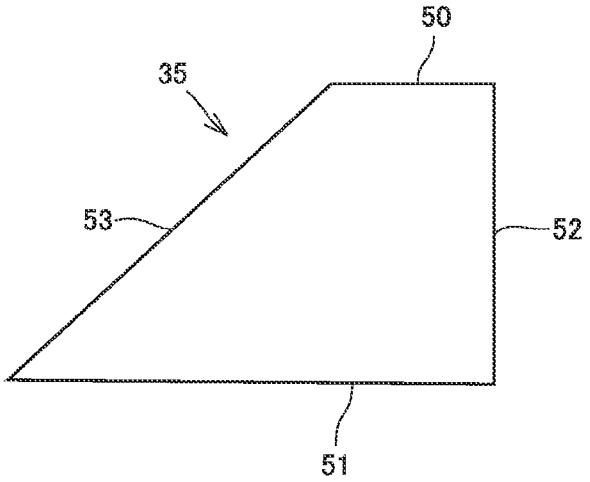
FIG. 6 is a plan view showing a divided ferrite 35.

FIG. 6 is a plan view showing divided ferrite 35. As shown in FIG. 6, divided ferrite 35 is formed in a trapezoidal shape.

Divided ferrite 35 includes a short side 50, a long side 51 arranged at a distance from short side 50, a connection side 52 (a first side portion) connecting one end of short side 50 and one end of long side 51 to each other, and an oblique side 53 connecting the other end of short side 50 and the other end of long side 51 to each other. Oblique side 53 is longer than connection side 52.

Though divided ferrite 35 is formed in a shape of a right-angled trapezoid in the example shown in FIG. 6, it does not necessarily have to be formed in the shape of the right-angled trapezoid and connection side 52 does not necessarily have to be connected at a right angle to short side 50 and long side 51.

Figure 7:
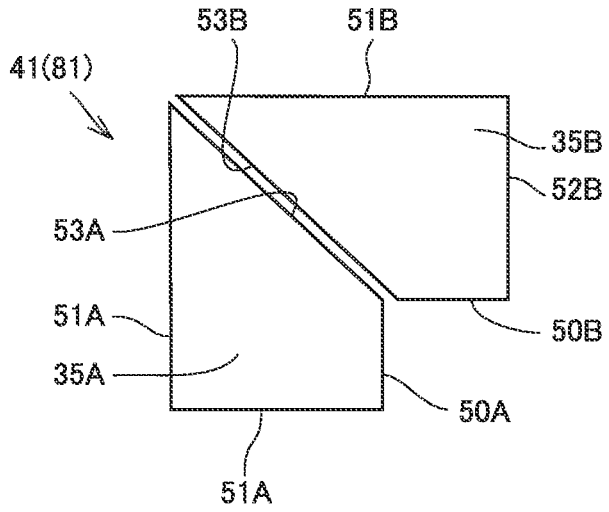
FIG. 7 is a plan view showing a corner piece 41.

FIG. 7 is a plan view showing corner piece 41. As shown in FIG. 7, corner piece 41 includes a divided ferrite 35A and a divided ferrite 35B, and is arranged such that an oblique side 53A of divided ferrite 35A and an oblique side 53B of divided ferrite 35B are opposed to each other.

An inner peripheral side of corner piece 41 is formed by a short side 50A of divided ferrite 35A and a short side 50B of divided ferrite 35B.

An outer peripheral side of corner piece 41 is formed by a long side 51A of divided ferrite 35A and a long side 51B of divided ferrite 35B.

A gap is provided between oblique side 53A of divided ferrite 35A and oblique side 53B of divided ferrite 35B. The gap is not essential and divided ferrite 35A and divided ferrite 35B may be in contact with each other.

Figure 8:
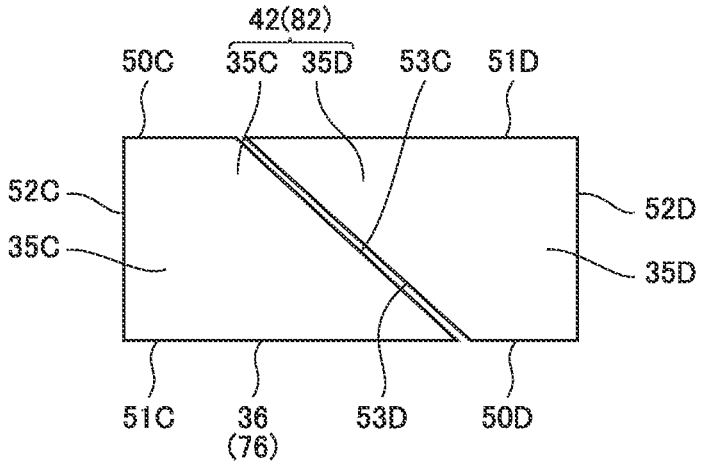
FIG. 8 is a plan view showing a side piece 42.

FIG. 8 is a plan view showing side piece 42. As shown in FIG. 8, side piece 42 includes a divided ferrite 35C and a divided ferrite 35D. Divided ferrite 35C and divided ferrite 35D are arranged such that an oblique side 53C and an oblique side 53D are opposed to each other.

A long side 51C of divided ferrite 35C and a short side 50D of divided ferrite 35D form an inner peripheral side of side piece 42. A short side 50C of divided ferrite 35C and a long side 51D of divided ferrite 35D form an outer peripheral side of side piece 42.

Coil base 31 is formed by arranging side pieces 42 between corner pieces 41 as shown in FIG. 5.

Figure 9:
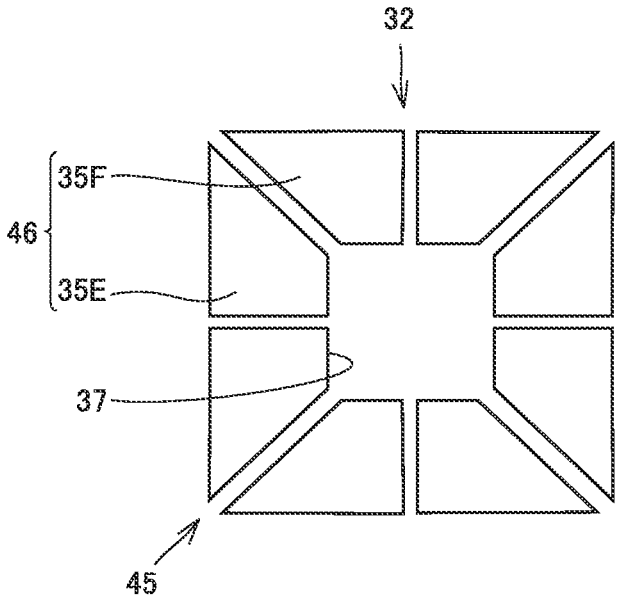
FIG. 9 is a plan view showing a central ferrite 32.

FIG. 9 is a plan view showing central ferrite 32. As shown in FIG. 9, central ferrite 32 includes a plurality of corner portions 45. Central ferrite 32 includes a plurality of central corner pieces 46 which form corner portion 45, and is formed by arranging central corner pieces 46 in a form of a frame.

Figure 10:
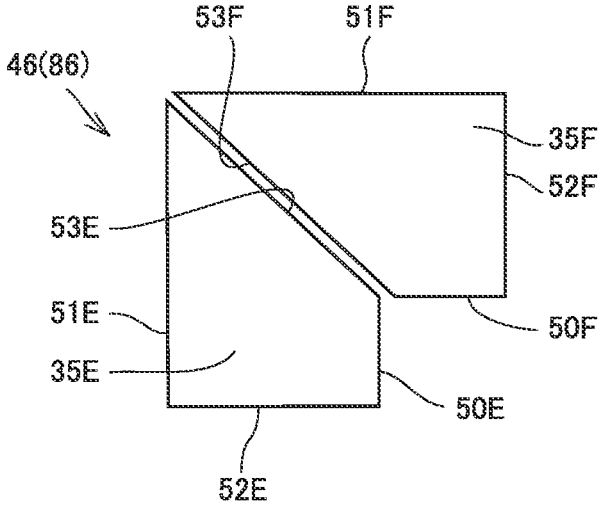
FIG. 10 is a plan view showing a central corner piece 46.

FIG. 10 is a plan view showing central corner piece 46. As shown in FIG. 10, central corner piece 46 includes a divided ferrite 35E and a divided ferrite 35F.

Divided ferrite 35E and divided ferrite 35F are arranged such that an oblique side 53E and an oblique side 53F are opposed to each other.

An inner peripheral side of central corner piece 46 is formed by short sides 50E and 50F of respective divided ferrites 35E and 35F. An outer peripheral side of central corner piece 46 is formed by long sides 51E and 51F.

An end side of central corner piece 46 is formed by a connection side 52E or a connection side 52F.

Central ferrite 32 is formed by arranging thus formed central corner pieces 46 in a form of a frame. Specifically, the central ferrite is arranged such that end side portions of central corner pieces 46 are opposed to each other.

Figure 11:
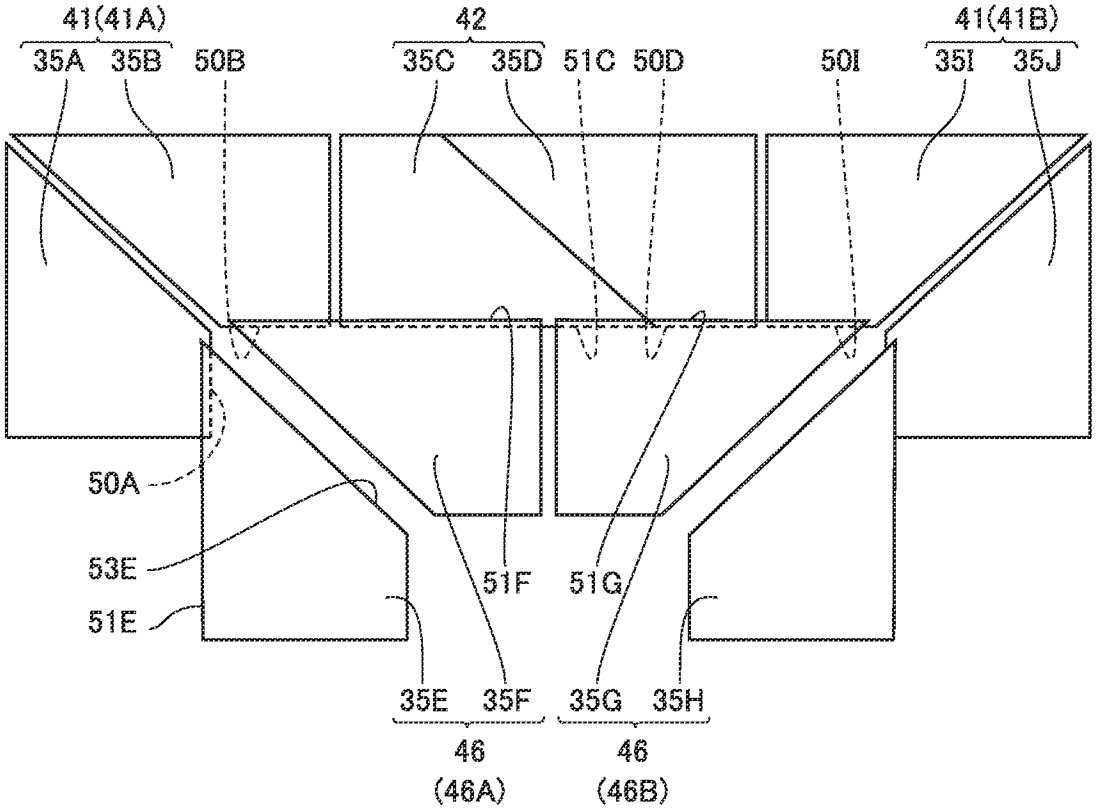
FIG. 11 is a plan view showing a part of ferrite 30.

FIG. 11 is a plan view showing a part of ferrite 30. As shown in FIG. 11, central corner pieces 46 are arranged on the inner peripheral side of corner piece 41 and side piece 42.

In FIG. 11, a central corner piece 46B including a divided ferrite 35G and a divided ferrite 35H is arranged adjacently to a central corner piece 46A including divided ferrite 35E and divided ferrite 35F.

A corner piece 41A including divided ferrites 35A and 35B, side piece 42 including divided ferrites 35C and 35D, and a corner piece 41B including divided ferrites 35I and 35J are disposed.

A part of short side 50A of divided ferrite 35A is exposed through a gap between divided ferrite 35E and divided ferrite 35F.

A width of the gap between divided ferrite 35E and divided ferrite 35F is much shorter than a length of short side 50, and a length of the portion of short side 50A exposed through the gap is shorter than the width of the gap. Therefore, most part of short side 50A is located on a lower surface of divided ferrite 35E.

Thus, most part of short side 50A and a portion located in the vicinity thereof are in contact with divided ferrite 35E, and an area of contact between divided ferrite 35A and divided ferrite 35E is ensured. Thus, occurrence of magnetic saturation in a portion of contact between divided ferrite 35A and divided ferrite 35E at the time when a magnetic flux is formed around electric power transmission coil 12 and the magnetic flux flows through coil base 31 during electric power transmission can be suppressed.

Similarly, most part of short side 50B and a portion located in the vicinity thereof are in contact with a lower surface of divided ferrite 35F. Thus, an area of contact between divided ferrite 35B and divided ferrite 35F is ensured, and occurrence of magnetic saturation in the portion of contact between divided ferrite 35B and divided ferrite 35F during electric power transmission can be suppressed.

A part of long side 51C of divided ferrite 35C is exposed through a gap between divided ferrite 35F and divided ferrite 35G. Here, a width of the gap between divided ferrite 35F and divided ferrite 35G is much shorter than long side 51C. Therefore, most part of long side 51C is in contact with a lower surface of divided ferrite 35F or divided ferrite 35G. Therefore, an area of contact between divided ferrite 35C and central ferrite 32 is large, and occurrence of magnetic saturation in the portion of contact of divided ferrite 35C is suppressed.

In divided ferrite 35D, the entire short side 50D is in contact with the lower surface of divided ferrite 35G. Therefore, an area of contact between divided ferrite 35D and divided ferrite 35G is large and occurrence of magnetic saturation in the portion of contact of divided ferrite 35D is suppressed.

Thus, an area of contact with central ferrite 32 is ensured in any of each corner piece 41 and each side piece 42, and occurrence of magnetic saturation in corner piece 41 and side piece 42 during transmission of electric power is suppressed. Since coil base 31 is formed with a plurality of corner pieces 41 and side pieces 42 being disposed, occurrence of magnetic saturation in coil base 31 is suppressed.

In divided ferrite 35F, most part of long side 51F is in contact with an upper surface of divided ferrite 35B or divided ferrite 35C. Only a portion of long side 51F located in a gap between divided ferrites 35B and 35C is not in contact with coil base 31. Since a distance between divided ferrites 35B and 35C is much shorter than long side 51F, most part of long side 51F is in contact with divided ferrite 35B or divided ferrite 35C. Therefore, an area of contact between divided ferrite 35F and coil base 31 is large, and magnetic saturation of divided ferrite 35F during transmission of electric power is suppressed.

Long side 51G of divided ferrite 35G is exposed through a gap between divided ferrite 35C and divided ferrite 35D and through a gap between divided ferrite 35D and divided ferrite 35I. A total of a distance between divided ferrites 35C and 35D and a distance between divided ferrites 35D and 35I is much shorter than long side 51G. Therefore, an area of contact between divided ferrite 35G and coil base 31 is large, and occurrence of magnetic saturation in divided ferrite 35G during transmission of electric power is suppressed.

Therefore, occurrence of magnetic saturation during transmission of electric power is suppressed also in each divided ferrite 35 forming central ferrite 32.

As shown in FIG. 5, coil base 31 according to the present embodiment is formed by arranging corner pieces 41 at a distance from each other and arranging side pieces 42 between corner pieces 41.

Figure 12:
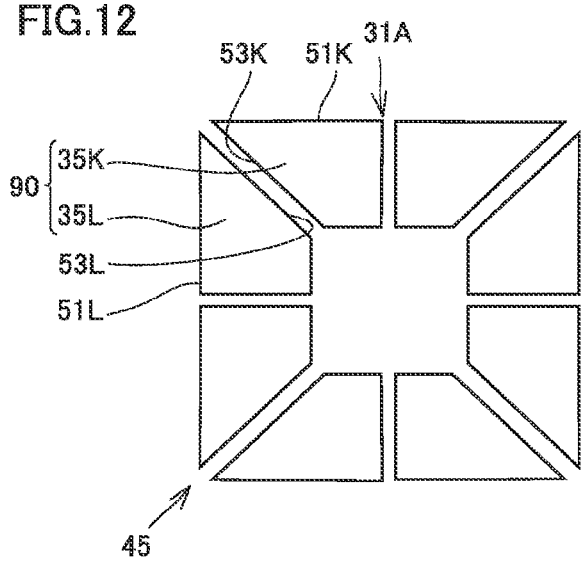
FIG. 12 is a plan view showing a coil base 31A according to a comparative example.

FIG. 12 is a plan view showing a coil base 31A according to a comparative example. Coil base 31A shown in FIG. 12 is formed from four corner pieces 90. Corner piece 90 includes a divided ferrite 35L and a divided ferrite 35K, and divided ferrite 35L and divided ferrite 35K are arranged such that oblique sides 53L and 53K are opposed to each other.

A long side 51L of divided ferrite 35L and a long side 51K of divided ferrite 35K form an outer peripheral side of corner piece 90.

Coil base 31A is formed by arranging thus constructed corner pieces 90 in a form of a frame, and a length of one side on an outer periphery of coil base 31A is calculated as a total of a length of two long sides 51 of divided ferrites 35 and a width of a gap between corner pieces 90.

A length of one side on an outer periphery of coil base 31 shown in FIG. 4 is calculated as a total of a length of three long sides 51 of divided ferrites 35, a length of short side 50, and widths of two gaps. Therefore, coil base 31 according to the present embodiment is greater than coil base 31A.

If a length of one side of coil base 31A shown in FIG. 12 should be equal to a length of one side of coil base 31 according to the present embodiment, a size of divided ferrites 35L and 35K shown in FIG. 12 should be increased.

If an attempt to form such a large divided ferrite is made, a fracture or a crack is likely in a divided ferrite in a manufacturing process, and manufacturing is actually very difficult.

As shown in FIG. 4, in the present embodiment, side pieces 42 are arranged between corner pieces 41, so that a size of each divided ferrite 35 can be made smaller while a size of coil base 31 is ensured.

Coil base 31 is formed from divided ferrites 35 identical in shape, and hence manufacturing cost can be suppressed as compared with formation of the coil base from a plurality of types of divided ferrites.

As shown in FIG. 4, central ferrite 32 is also formed from a divided ferrite identical in shape to divided ferrite 35 forming coil base 31. Therefore, manufacturing cost also for ferrite 30 as a whole can be reduced.

Figure 13:
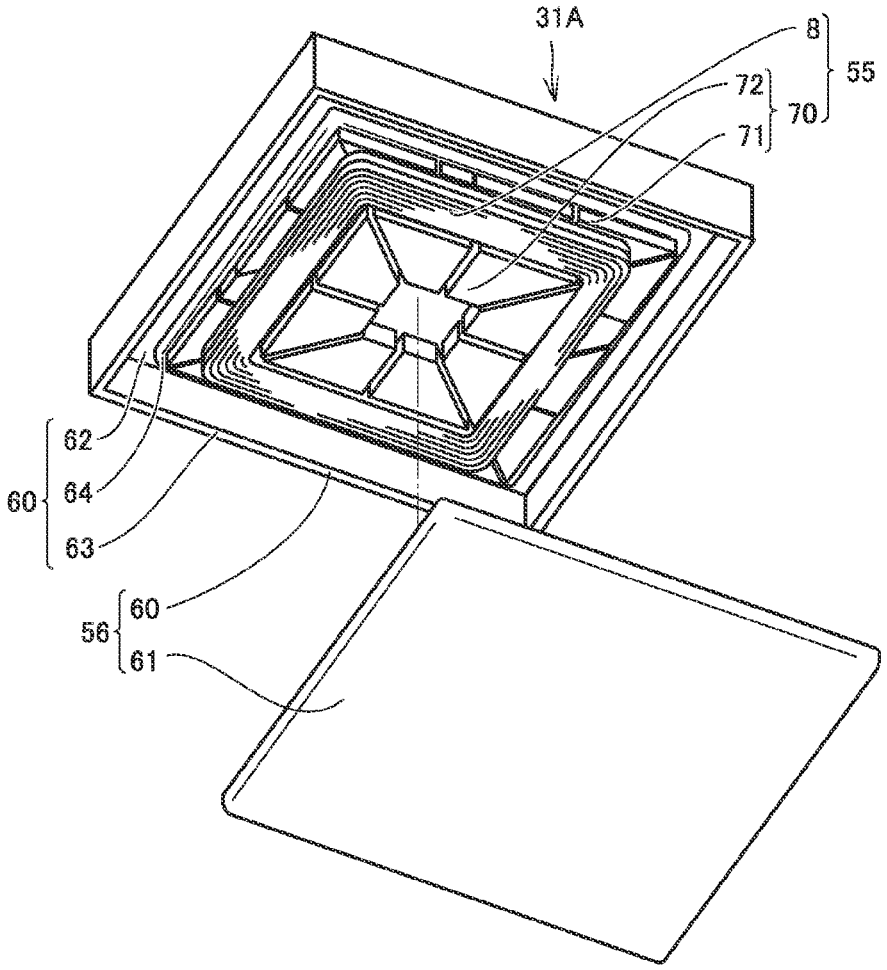
FIG. 13 is an exploded perspective view showing an electric power reception apparatus 5.

FIG. 13 is an exploded perspective view showing electric power reception apparatus 5. As shown in FIG. 13, electric power reception apparatus 5 includes a coil unit 55 and a housing 56 which accommodates coil unit 55.

Housing 56 includes a case main body 60 opening downward and a resin lid 61 provided to close the opening of case main body 60.

Case main body 60 includes a base plate 62, a peripheral wall portion 63 formed around an outer peripheral portion of base plate 62, and an accommodation portion 64 provided on a lower surface of peripheral wall portion 63 and accommodating rectifier 6 and capacitor 9. Coil unit 55 includes a ferrite 70 and electric power reception coil 8 arranged on a lower surface of ferrite 70.

Figure 14:
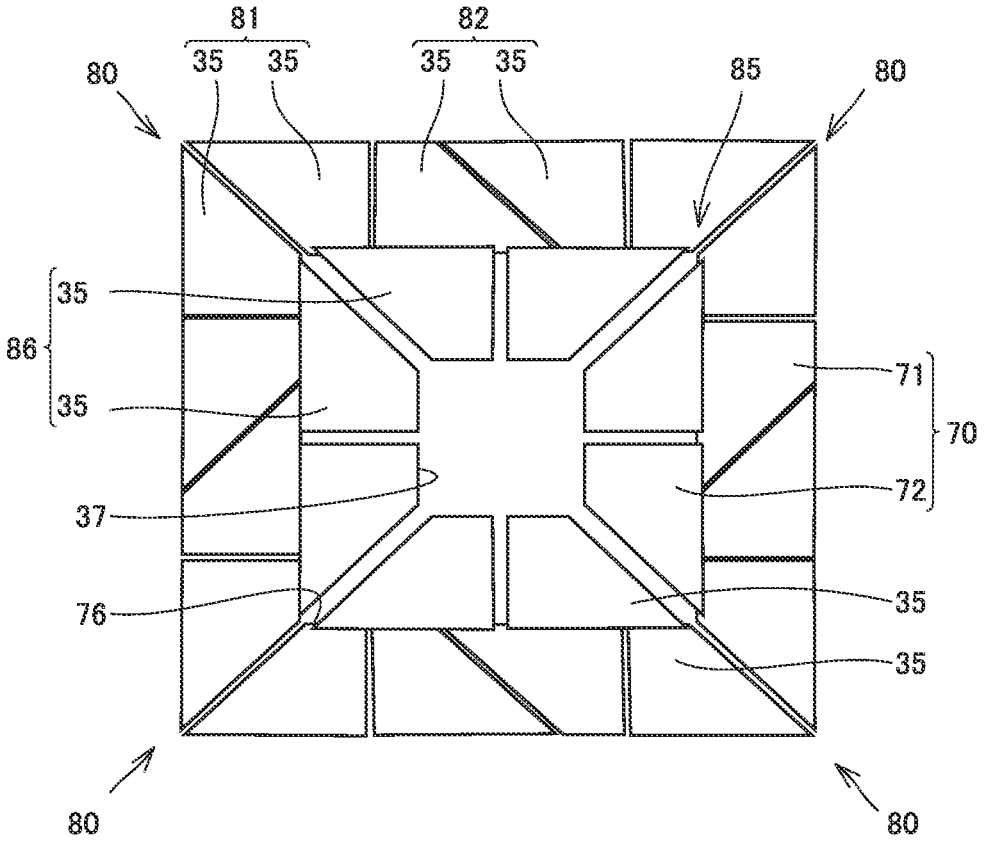
FIG. 14 is a plan view showing a ferrite 70 when two-dimensionally viewed from below electric power reception apparatus 5.

FIG. 14 is a plan view showing ferrite 70 when two-dimensionally viewed from below electric power reception apparatus 5.

As shown in FIG. 14, ferrite 70 includes a coil base 71 having electric power reception coil 8 arranged on a lower surface thereof and a central ferrite 72 arranged on the lower surface of coil base 71, and ferrite 70 is formed from a plurality of divided ferrites 35.

Coil base 71 is formed in a form of a frame, and an opening 76 is provided in a central portion of coil base 71. Central ferrite 72 is arranged on the lower surface of coil base 71 so as to be in contact with an inner peripheral portion of coil base 71. As shown in FIG. 13, electric power reception coil 8 is arranged on the lower surface of coil base 71, and electric power reception coil 8 is arranged to surround central ferrite 72. Ferrite 70 is formed similarly to ferrite 30 shown in FIG. 4.

Coil base 71 includes a plurality of corner portions 80, and coil base 71 includes corner pieces 81 which form a corner portion 80 and side pieces 82 arranged between corner pieces 81.

Corner piece 81 is formed similarly to corner piece 41 as shown in FIG. 7. Side piece 82 is formed similarly to side piece 42 as shown in FIG. 8.

Central ferrite 72 includes a plurality of corner portions 85. Central ferrite 72 is formed as a plurality of central corner pieces 86 forming corner portion 85 are arranged in a form of a frame. Central corner piece 86 is also formed similarly to central corner piece 46 as shown in FIG. 10.

Thus, coil base 71 and ferrite 70 provided in electric power reception apparatus 5 are constructed similarly to coil base 31 and ferrite 30 provided in electric power transmission apparatus 3, respectively. Therefore, a function and effect the same as in coil base 31 and ferrite 30 can be obtained.

Though an example including divided ferrite 35 in a shape of a right-angled trapezoid is described in the embodiment above, the shape of divided ferrite 35 is not limited thereto.

Figure 15:
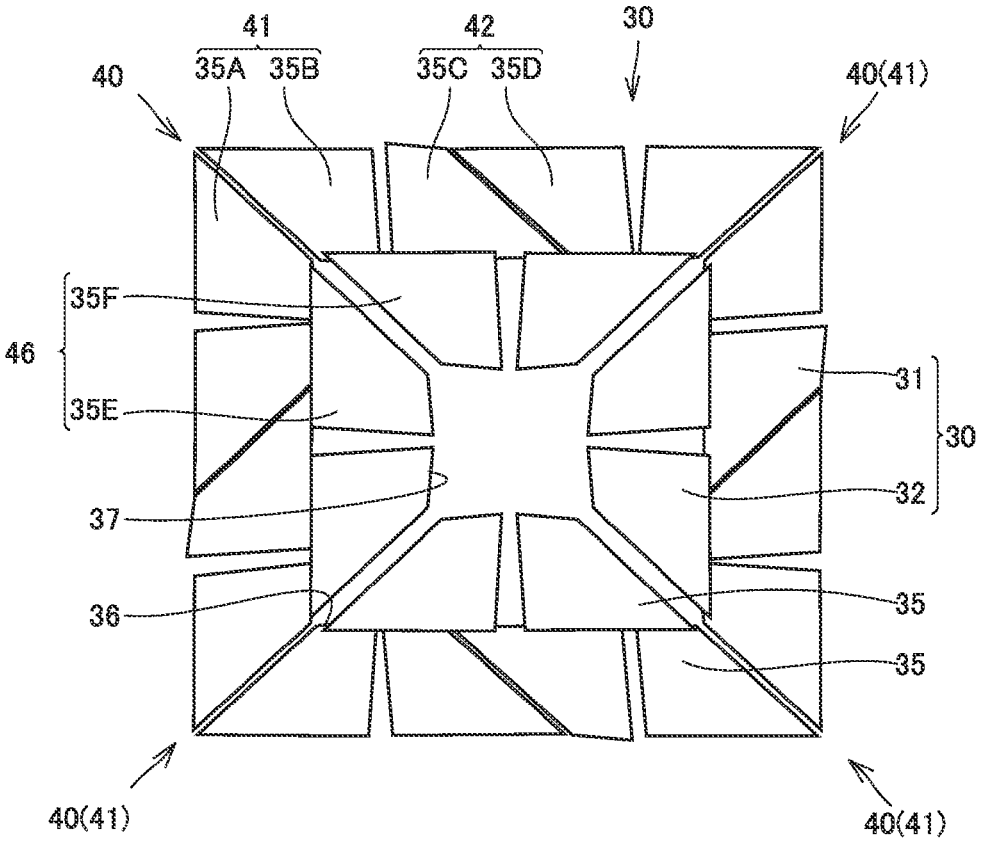
FIG. 15 is a plan view showing a modification of ferrite 30.
Figure 16:
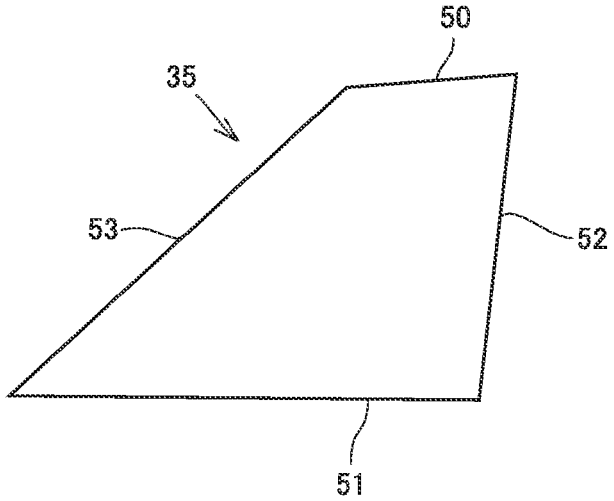
FIG. 16 is a plan view showing a modification of divided ferrite 35.

FIG. 15 is a plan view showing a modification of ferrite 30 and FIG. 16 is a plan view showing a modification of divided ferrite 35.

In the example shown in FIG. 16, divided ferrite 35 includes short side 50, long side 51 provided at a position distant from short side 50, connection side 52 connecting one side of short side 50 and one side of long side 51 to each other, and oblique side 53 connecting the other end of short side 50 and the other end of long side 51 to each other. Oblique side 53 is constructed to be longer than connection side 52. An angle formed between short side 50 and connection side 52 is not 90 degrees but is smaller than 90 degrees. An angle formed between long side 51 and connection side 52 is again not 90 degrees but is greater than 90 degrees.

Ferrite 30 shown in FIG. 15 is formed by arranging a plurality of divided ferrites 35 shown in FIG. 16. In the example shown in FIG. 15 as well, corner piece 41 is formed from divided ferrite 35A and divided ferrite 35B and arranged such that oblique sides 53 of divided ferrites 35A and 35B are opposed to each other. Short sides 50 of divided ferrites 35A and 35B form the inner peripheral side of corner piece 41 and long sides 51 of divided ferrites 35A and 35B form the outer peripheral side of corner piece 41.

Side piece 42 is formed from divided ferrite 35C and divided ferrite 35D and arranged such that oblique sides 53 of divided ferrites 35C and 35D are opposed to each other. An inner peripheral side of side piece 42 is formed from long side 51 of divided ferrite 35C and short side 50 of divided ferrite 35D, and an outer peripheral side of side piece 42 is formed from short side 50 of divided ferrite 35C and long side 51 of divided ferrite 35D. Central corner piece 46 is also formed from divided ferrites 35F and 35E.

As shown in FIG. 15, each divided ferrite 35 forming coil base 31 is in contact with central ferrite 32 in a most part of short side 50 or most part of long side 51. Therefore, in the example shown in FIG. 15 as well, occurrence of magnetic saturation during transmission of electric power in each divided ferrite 35 can be suppressed. Various shapes of divided ferrite 35 can thus be adopted.

Though the embodiment of the present invention has been described, it should be understood that the embodiment disclosed herein is illustrative and non-restrictive in every respect. The scope of the present invention is defined by the terms of the claims and is intended to include any modifications within the scope and meaning equivalent to the terms of the claims.

What is claimed is:

1. A coil unit comprising:

a coil; and a ferrite including a coil base in a form of a frame, on which the coil is arranged, and formed from a plurality of divided ferrites, the coil base including a plurality of corner portions, the coil base including a plurality of corner pieces which form the corner portion and are provided at a distance from each other and side pieces provided between the corner pieces, the divided ferrite including a short side portion, a long side portion provided at a distance from the short side portion and being longer than the short side portion, a first side portion connecting one end of the short side portion and one end of the long side portion to each other, and a second side portion connecting the other end of the short side portion and the other end of the long side portion to each other and being longer than the first side portion, the plurality of divided ferrites including a first divided ferrite and a second divided ferrite which form the corner piece and a third divided ferrite and a fourth divided ferrite which form the side piece, the first divided ferrite and the second divided ferrite being arranged such that the second side portions are opposed to each other, an inner peripheral side of the corner piece being formed from a short side portion of the first divided ferrite and a short side portion of the second divided ferrite, and an outer peripheral side of the corner piece being formed from a long side portion of the first divided ferrite and a long side portion of the second divided ferrite, and the third divided ferrite and the fourth divided ferrite being arranged such that the second side portions are opposed to each other, an inner peripheral side of the side piece being formed from a short side portion of the third divided ferrite and a long side portion of the fourth divided ferrite, and an outer peripheral side of the side piece being formed from a long side portion of the third divided ferrite and a short side portion of the fourth divided ferrite.

2. The coil unit according to claim 1, wherein the ferrite includes a central ferrite arranged to be in contact with an inner peripheral portion of the coil base and surrounded by the coil, the central ferrite includes a plurality of corner portions, the central ferrite includes a plurality of central corner pieces which form the corner portion of the central ferrite and are arranged in a form of a frame, and the plurality of divided ferrites include a fifth divided ferrite and a sixth divided ferrite which form the central corner piece, the fifth divided ferrite and the sixth divided ferrite are arranged such that the second side portions are opposed to each other, an inner peripheral side of the central corner piece is formed from a short side portion of the fifth divided ferrite and a short side portion of the sixth divided ferrite, and an outer peripheral side of the central corner piece is formed from a long side portion of the fifth divided ferrite and a long side portion of the sixth divided ferrite.

* * * * *